United States Patent [19]

Shinnai et al.

[11] Patent Number: 4,954,797

[45] Date of Patent: Sep. 4, 1990

[54] VEHICLE WINDOW GLASS ANTENNA COUPLED WITH DEFOGGING HEATER

[75] Inventors: Masao Shinnai; Kazuya Nishikawa; Tokio Tsukada; Tohru Hirotsu, all of Matsusaka, Japan

[73] Assignee: Central Glass Company, Limited, Ube, Japan

[21] Appl. No.: 248,093

[22] Filed: Sep. 23, 1988

[51] Int. Cl.[5] ..... H01Q 1/02; H01Q 1/32

[52] U.S. Cl. ..... 343/704; 343/713; 219/203

[58] Field of Search ..... 343/704, 711, 712, 713; 219/203, 522

[56] References Cited

U.S. PATENT DOCUMENTS

| | | | |
|---|---|---|---|
| 4,260,989 | 4/1981 | Ishii et al. | 343/713 |
| 4,439,771 | 3/1984 | Kume et al. | 343/704 |
| 4,608,570 | 8/1986 | Inada et al. | 343/704 |
| 4,736,206 | 4/1988 | Sakurai et al. | 343/713 |

FOREIGN PATENT DOCUMENTS

| | | | |
|---|---|---|---|
| 0140301 | 11/1980 | Japan | 343/713 |
| 0044201 | 4/1981 | Japan | 343/711 |
| 0125501 | 8/1982 | Japan | 343/713 |
| 0007203 | 1/1985 | Japan | 343/713 |

*Primary Examiner*—Rolf Mille
*Assistant Examiner*—Hoanganh Le
*Attorney, Agent, or Firm*—Fleit, Jacobson, Cohn, Price, Holman & Stern

[57] ABSTRACT

On a vehicle window glass provided with defogging heater strips, such as automobile rear window glass, the invention provides an antenna of improved efficiency for receiving FM and AM radio broadcast waves. In an area left above the heater strips the antenna is constructed of at least three elements each of which is a conductive strip. The first and main element is a T-shaped element with its horizontal part at a short distance from the upper edge of the window glass. On one side of the vertical part of the T-shaped element, the second element extends horizontally from a point on that vertical part. The third element, which is located on the other side of that vertical part, has a primary part which constitutes at least three sides of a horizontally elongate rectangle and a secondary part which extends horizontally from a point on the vertical part of the T-shaped element and connects with the primary part. A lead extends from a side of the rectangle to a feed point. The antenna is coupled with the heater strips by a conductive line which connects with the heater strips and has a horizontal part that makes capacitive coupling with the horizontal part of the T-shaped element.

13 Claims, 4 Drawing Sheets

VEHICLE WINDOW GLASS ANTENNA COUPLED WITH DEFOGGING HEATER

BACKGROUND OF THE INVENTION

This invention relates to a vehicle window glass antenna for receiving radio broadcast waves, and more particularly to an antenna constructed of conductive strips formed on or in a vehicle window glass which is provided with defogging heater strips, such as an automobile rear window glass.

In recent automobiles there is a trend to adoption of a so-called window glass antenna for receiving broadcast waves. In most cases the window glass antenna is provided to the rear window glass and is constructed of a conductive strips disposed on the glass pane in a suitable pattern, and the antenna is located in a relatively narrow space left above an array of defogging heater strips. Usually the conductive strips used as the antenna elements are electrically independent of the heater strips as shown, for example, in U.S. Pat. No. 4,608,570.

With an automobile window glass antenna of the above described type it is possible to receive FM radio broadcast waves with fairly high gains, but it is difficult to receive AM radio broadcast waves with sufficient gains mainly because of narrowness of the space which the antenna is allowed to occupy. As a compensatory measure, it is known to make an electrical connection between the antenna strips and the heater strips to utilize the heater strips as auxiliary elements of the antenna, and vice versa. However, this measure has a disadvantage that during defogging operation intrusion of considerable noise into the received signal is inevitable.

SUMMARY OF THE INVENTION

The present invention is concerned with vehicle window glasses provided with defogging heater strips, in particular the rear window glass of automobiles, and has an object of providing a window glass antenna which functions as a wide-band antenna capable of noiselessly receiving AM radio broadcast waves as well as FM radio broadcast waves with sufficient gains.

The present invention provides a vehicle window glass antenna attached to a vehicle window glass which is provided with a plurality of heater strips extending horizontally. The antenna is located above the heater strips and comprises a first element which is a T-shaped conductive strip comprising a horizontal part and a vertical part extending from the horizontal part toward the heater strips, a second element which is a conductive strip and extends horizontally from a point on the vertical part of the first element so as to exist only on one side of said vertical part, a third element which is a conductive strip and comprises a primary part which constitutes at least three sides of a horizontally elongate rectangle on the other side of the vertical part of the first element and a secondary part which extends horizontally from a point on said vertical part and connects to the primary part, a connecting line which extends from a point on the primary part of the third element to a feed point disposed on the window glass, and an auxiliary conductive line which connects to the heater strips and comprises a horizontal part which makes capacitive coupling with the horizontal part of the first element.

Besides the above defined essential elements, an antenna according to the invention may optionally include an auxiliary element which is a conductive strip and extends horizontally from the lower end of the vertical part of the T-shaped first element. Optionally the antenna may be provided with another auxiliary conductive line which connects to the heater strips and comprises a horizontal part which makes capacitive coupling with at least one of the second antenna element, the secondary part of the third element and the auxiliary element.

The present invention is very suitable for application to the rear window glass of an automobile. An antenna according to the invention exhibits sufficiently high gains in receiving not only FM radio broadcast waves, in both the 76–90 MHz band used in Japan and the 88–108 MHz band used in many other countries, but also AM radio broadcast waves. With this antenna noiseless reception of broadcast waves is made though the antenna is coupled with the defogging heater strips.

In receiving FM radio broadcast waves the T-shaped first element of the antenna functions as the main element of the antenna, while the second element serves the purpose of eliminating or compensating a phase difference between the direct wave and indirect waves attributed to reflections from the ground, car body, human bodies, buildings, etc. and thereby improving the directional characteristics of the antenna and increasing the receiving gain. The third element of the antenna is included mainly for adjusting the impedance of the antenna to approximate to the impedance of a coaxial cable (usually 75 ohms) used as the feeder and thereby increasing the receiving gain.

In receiving AM radio broadcast waves, the capacitive coupling of the auxiliary conductive line(s) with the heater strips contributes to enhancement of the receiving gain because, in addition to the high-frequency current induced in the first, second and third elements of the antenna, a high-frequency current induced in the heater strips is also picked up.

An antenna according to the invention is attached to a surface of a window glass pane or embedded in a laminated glass pane.

DESCRIPTION OF THE PREFERRED EMBODIMENTS

Figure 1:
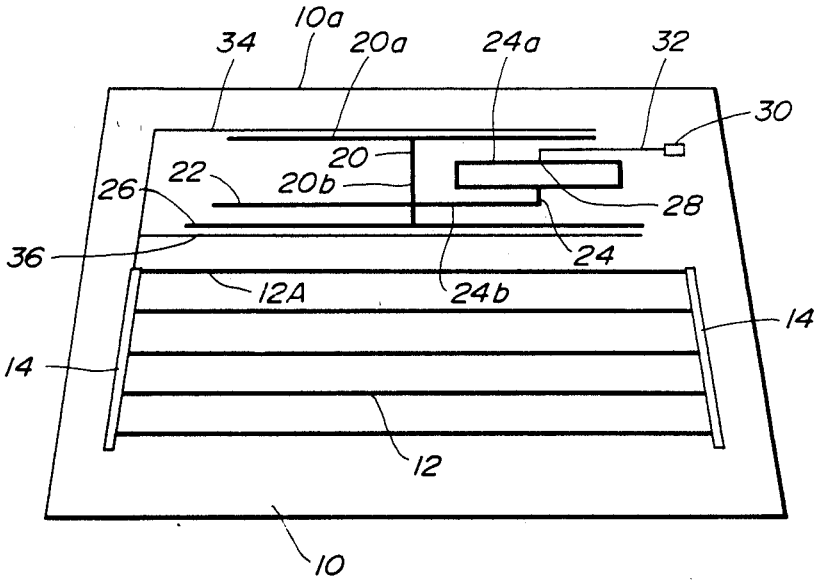
FIG. 1 is a plan view of an automobile rear window glass provided with conventional defogging heater strips and an antenna as a first embodiment of the invention.

FIG. 1 shows an automobile rear window glass in which the present invention is embodied. Numeral 10 indicates a glass pane. An array of defogging heater strips 12 is disposed on the inboard surface of the glass pane 10 so as to leave a free area in an upper part of the glass pane 10. Numeral 14 indicates a pair of bus bars to which each heater strip 12 is connected. As usual, the heater strips 12 and bus bars 14 are formed by printing a conductive paste onto the glass surface and, after drying, baking the glass pane with the printed paste thereon.

An antenna according to the invention is disposed on the inboard surface of the glass pane 10 by using the free area left between the upper edge 10*a* of the glass pane and the uppermost heater strip 12A. The antenna has four elements, viz. first element 20, second element 22, third element 24 and an auxiliary element 26, each of which is a conductive strip formed by the same method as the heater strips 12.

The first element 20 of the antenna is a T-shaped element having a horizontal and relatively long part 20*a*, which extends parallel to and at a short distance from the upper edge 10*a* of the glass pane, and a vertical part 20*b* which extends downward from the middle point of the horizontal part 20*a*. The second element 22 extends horizontally and terminates at a point on the vertical part 20*b* of the first element 20. The third element 24 has a main part 24*a* in the shape of a horizontally elongate rectangle, which is located below the horizontal part 20*a* of the first element 20 without intersecting the vertical part 20*b* of the first element, and a horizontal part 24*b* which extends from a point on the vertical part 20*b* of the first element and connects with the lower side of the rectangle 24*a*. The second element 22 is disposed on one side of the vertical part 20*b* of the first element and the third element 24 on the opposite side. The auxiliary element 26 extends horizontally below the second and third elements 22 and 24 connects with the lower end of the vertical part 20*b* of the first element 20. The antenna is connected to a feed point 30 located in a side marginal region of the glass pane 10 by a lead 32 which extends from a point 28 on a horizontal side of the rectangle 24*a* of the third element 24.

In an open space above the horizontal part 20*a* of the first element 20 a first auxiliary conductive line 34 extends parallel to that part 20*a* of the first antenna element. This conductive line 34 turns downward in a side marginal region of the glass pane 10 to connect with the heater strips 12 via one of the bus bars 14. The vertical distance between the conductive line 34 and the first element 20 is such that the conductive line 34 makes capacitive coupling with the horizontal part 20*a* of the first element. The vertical distance of the conductive line 34 from the upper edge 10*a* of the glass pane may be as short as about 10 mm, but preferably this distance is adjusted to about 15–25 mm because by doing so the receiving gains of the antenna can be increased. In this embodiment there is a second auxiliary conductive line 36 which extends below and parallel to the auxiliary element 26 of the antenna and connects to the first auxiliary conductive line 34 to thereby connect with the heater strips 12. The vertical distance of this conductive line 36 from the auxiliary element 26 is such that the conductive line 36 makes capacitive coupling with the auxiliary element 26.

In a sample of the window glass of FIG. 1 the glass pane 10 was 1120 mm in the length of the upper edge 10*a*, 1400 mm in the length of the lower edge and 570 mm in the vertical length, and the dimensions of and relating to the antenna elements were as follows.

The first element 20: the horizontal part 20*a* was 1100 mm in length (550 mm on either side of the vertical part 20*b*), and the vertical part 20*b* was 100 mm in length.

The second element 22 had a length of 570 mm.

The third element 24: the rectangular part 24*a* was 540 mm in horizontal length, 30 mm in vertical length and at a horizontal distance of 40 mm from the vertical part 20*b* of the first element; and the horizontal part 24*b* was 290 mm in length.

The auxiliary element 26 had a length of 1160 mm (580 mm on either side of the vertical part 20*b* of the first element).

The first auxiliary conductive line 34 was at a vertical distance of 15 mm from the upper edge 10*a* of the glass pane and at a vertical distance of 2 mm from the horizontal part 20*a* of the first element 20. The upper side of the rectangle 24*a* was at a vertical distance of 40 mm from the horizontal part 20*a* of the first element, and the lower side of the rectangle 24*a* was at a vertical distance of 15 mm from the horizontal part 24*b* of the third element 24. The auxiliary antenna element 26 was at a vertical distance of 15 mm from the horizontal part 24*b* of the third element. The second auxiliary conductive line 36 was at a vertical distance of 2 mm from the auxiliary antenna element 26 and at a vertical distance of 10 mm from the uppermost heater strip 12A.

Gains of this sample antenna in receiving FM radio broadcast waves were measured and compared with gains of a standard dipole antenna. That is, for any frequency the gain of the dipole antenna was taken as the basis, 0 dB, and the gain of the sample antenna was marked on this basis. As the result, gain of the sample antenna was −19.6 dB on an average in the Japanese domestic FM radio broadcasting band of 76–90 MHz and −19.9 dB on an average in the foreign FM broadcasting band of 88–108 MHz. For comparison, by the same testing a superior example of conventional window glass antennas in practical use exhibited an average gain (vs. dipole antenn) of about −22.5 dB in both the 76–90 MHz band and the 88–108 MHz band. Therefore, the window glass antenna of FIG. 1 is judged to be a good and practicable antenna for receiving FM broadcast waves.

Gains of the same sample antenna of FIG. 1 in receiving AM radio broadcast waves were measured and compared with gains of a 1 m long whip antenna. That is, for any frequency the gain of the whip antenna was taken as the basis, 0 dB, and the gain of the sample antenna was marked on this basis. As the result, gain of the sample antenna was −7.6 dB on an average in the AM broadcasting band of 535–1605 KHz. In the case of the aforementioned example of conventional window glass antennas the average gain (vs. whip antenna) was −10.5 dB. Accordingly the antenna of FIG. 1 is judged to be a good and practicable antenna for receiving AM broadcast waves too.

In the present invention the first auxiliary conductive line 34, which connects with the heater strips 12 and makes capacitive coupling with the horizontal part 20*a* of the first antenna element 20, is indispensable. It is preferable but is not indispensable to include the second auxiliary conductive line 36 which makes capacitive coupling with the horizontal part(s) of the second, third and/or auxiliary antenna elements 22, 24, 26. Assuming a possible case where the second auxiliary conductive line 36 in FIG. 1 is omitted and an impermissible case where the first auxiliary conductive line 34 is omitted, the antenna exibits higher gains in the former case than in the latter case. Probably the vertical portion of each conductive line makes some contribution to enhancement of the receiving gain, and hence the first conductive line 34 having a vertical portion longer than the second conductive line 36 is more effective. The addition of the second conductive line 36 brings about an increase in the receiving gain of the antenna. This is probably attributed to the increased length of capacitive coupling between the antenna elements and the auxiliary conductive lines 34, 36.

Figure 2:
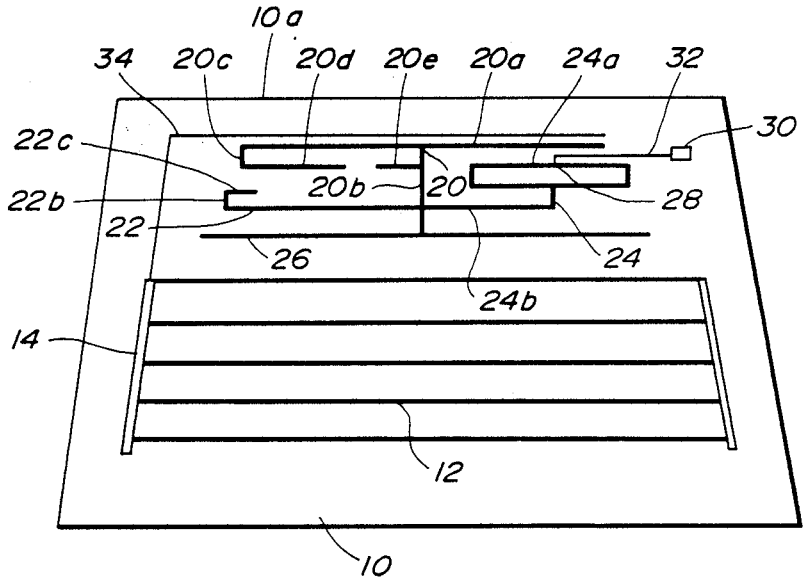
FIGS. 2 to 4 show three different modifications of the antenna of FIG. 1, respectively.

FIG. 2 shows a second embodiment of the invention on the same automobile rear window glass. The antenna in FIG. 2 is a modification of the antenna of FIG. 1 only in the following points.

In an area above the second element 22, the horizontal part 20a of the T-shaped first element 20 is supplemented at its lefthand end with a short turn-down part 20c and a turn-back part 20d which extends horizontally from the lower end of the turn-down part 20c toward the vertical part 20b but does not reach the vertical part 20b, and a relatively short branch part 20e extends horizontally from a point on the vertical part 20b toward the turn-back part 20d. The second element 22 is supplemented at its lefthand end with a short turn-up part 22b and a short turn-back part 22c which extends horizontally from the upper end of the turn-up part 22b toward the vertical part 20b of the first element 20. In this antenna there is no counterpart of the second auxiliary conductive line 36 in FIG. 1.

In receiving FM radio broadcast waves the antenna of FIG. 2 proved to be nearly equivalent in gains to the antenna of FIG. 1. In receiving AM broadcast waves a sample antenna of FIG. 2 exhibited an average gain of −8.0 dB (vs. whip antenna) in the 535–1605 KHz band.

As illustrated by the embodiment of FIG. 2 the horizontal part 20a of the T-shaped first element 20 may turn at an end portion to provide a turn-back part (20d), and/or the vertical part 20b may be supplemented with a branch part (20e), or branch parts, extending horizontally. It is also optional to employ a plurality of parallel strips to constitute the horizontal part (20a) of the T-shaped first element 20. The second element 22 may turn at its free end portion to provide a turn-back part (22c) or may be constructed of a plurality of parallel strips extending horizontally. The auxiliary element 26 can be omitted, though inclusion of this element is effective for increasing receiving gains of the antenna. The auxiliary element 26, which is an optional element, may turn at a free end portion to provide a turn-back part or may have the shape of a horizontally elongate rectangle. Optionally the uppermost heater strip 12A can be utilized as a substitute for the second auxiliary conductive line 36. Each of the auxiliary conductive line 34, 36 is not necessarily connected to the bus bar 14 or an end section of a heater strip 12 and may alternatively be connected to a middle or any other section of a heater strip 12.

In the following embodiments of the invention some of the above described optional modifications are selectively employed.

Figure 3:
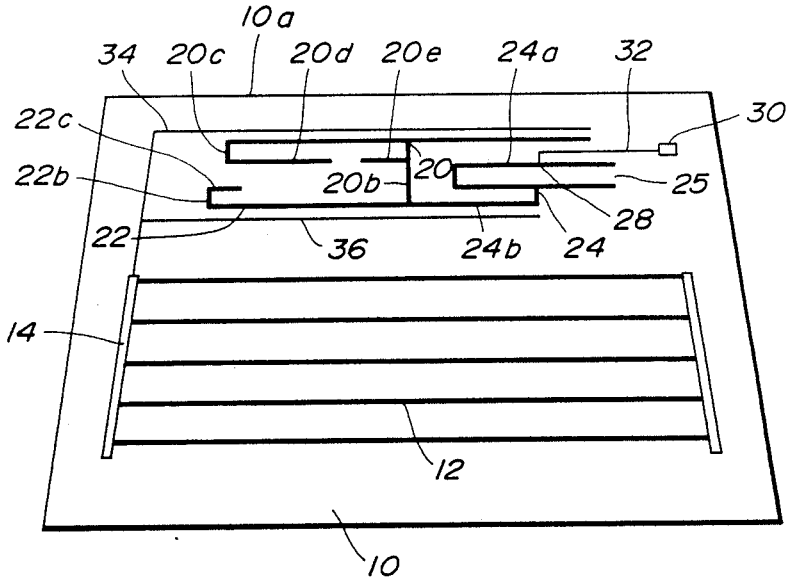

FIG. 3 shows a third embodiment of the invention on the same automobile rear window glass. The antenna in FIG. 3 is a modification of the antenna of FIG. 1 in the following points.

Similarly to the antenna of FIG. 2 the first element 20 is supplemented with the turn-down part 20c, turn-back part 20d and branch part 20e, and the second element 22 is supplemented with the turn-up part 22b and turn-back part 22c. In this antenna the rectangular part 24a of the third element 24 is reduced by omitting one of the two vertical sides of the rectangle so that a gap 25 is produced between the righthand ends of the two horizontal sides of the rectangle. The auxiliary antenna element 26 shown in FIG. 1 is omitted in the antenna of FIG. 3, and the second auxiliary conductive line 36 extends at a short distance from the second and third elements 22, 24 so as to make capacitive coupling with both the second element 22 and the horizontal part 24b of the third element.

Compared with the antenna of FIG. 1, the antenna of FIG. 3 exhibited only slightly lower gains in receiving either FM radio broadcast waves or AM radio broadcast waves.

Figure 4:
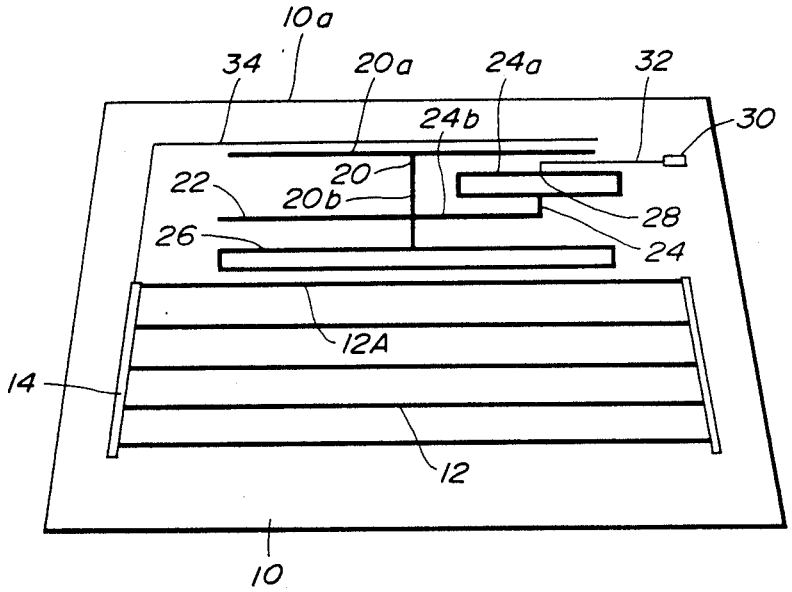

FIG. 4 shows a fourth embodiment of the invention on the same automobile rear window glass. The antenna in FIG. 4 is a modification of the antenna of FIG. 1 only in the following points.

In this antenna the auxiliary element 26 is in the shape of a rectangle which is horizontally elongate. This antenna has no counterpart of the second auxiliary conductive line 36 in the antenna of FIG. 1, and the rectangular auxiliary element 26 is so positioned as to make capacitive coupling with the uppermost heater strip 12A.

Compared with the antenna of FIG. 1 the antenna of FIG. 4 exhibited equivalent gains in receiving FM radio broadcast waves and somewhat higher gains in receiving AM radio broadcast waves.

Figure 5:
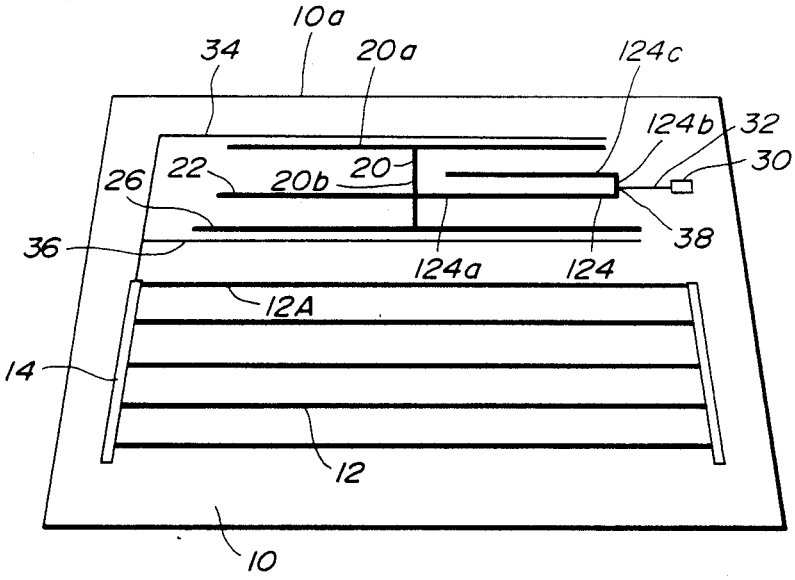
FIG. 5 is a plan view of an automobile rear window glass provided with conventional defogging heater strips and an antenna as a still different embodiment of the invention.

FIG. 5 shows a fifth embodiment of the invention on the same automobile rear window glass. The antenna in FIG. 5 is a modification of the antenna of FIG. 1 only in respect of the third element 24.

In this antenna the third element 124 consists of a base part 124a, which extends horizontally from a point on the vertical part 20b of the T-shaped first element 20 in the direction opposite to the second element 22, a short turn-up part 124b which extends vertically upward from the righthand end of the base part 124a and a turn-back part 124c which extends horizontally from the upper end of the turn-up part 124b toward the vertical part 20b of the first element 20 but does not reach the vertical part 20b. The antenna is connected to the feed point 30 by a lead 32 which extends from a point 38 on the turn-up part 124b of the third element 124.

In a sample of the window glass of FIG. 5 the glass pane 10 had the same dimensions as in the sample of the window glass of FIG. 1, and the dimensions of and relating to the antenna elements were as follows.

The first element 20: the horizontal part 20a was 1100 mm in length (550 mm on either side of the vertical part 20b), and the vertical part 20b was 105 mm in length.

The second element 22 had a length of 570 mm.

The third element 124: the base part 124 was 560 mm long; the turn-up part 124b had a length of 50 mm; and the turn-back part 124c was 530 mm long.

The auxiliary element 26 had a length of 1160 mm (580 mm on either side of the vertical part 20b of the first element).

The first auxiliary conductive line 34 was at a vertical distance of 15 mm from the upper edge 10a of the glass pane and at a vertical distance of 2 mm from the horizontal part 20a of the first element 20. The turn-up part 124c of the second element was at a distance of 35 mm from the horizontal part 20a of the first element. The auxiliary antenna element 26 was at a vertical distance of 20 mm from the base part 124a of the third element. The second auxiliary conductive line 36 was at a vertical distance of 2 mm from the auxiliary antenna element 26 and at a vertical distance of 10 mm from the uppermost heater strip 12A.

Gains of this sample antenna in receiving FM radio broadcast waves were measured and compared with gains of the standard dipole antenna, taking the gain of the dipole antenna for any frequency as the basis, 0 dB. As the result, gain of the sample antenna was −20.2 dB (vs. dipole antenna) on an average in the Japanese domestic FM radio broadcasting band of 76–90 MHz and −19.8 dB (vs. dipole antenna) on an average in the foreign FM broadcasting band of 88–108 MHz. Considering that the aforementioned example of conventional window glass antennas in practical use exhibited an average gain (vs. dipole antenn) of about −22.5 dB in both the 76–90 MHz band and the 88–108 MHz band, the window glass antenna of FIG. 5 is judged to be a good and practicable antenna for receiving FM broadcast waves.

Gains of the same sample antenna of FIG. 5 in receiving AM radio broadcast waves were measured and compared with gains of a 1 m long whip antenna, taking the gain of the whip antenna for any frequency as the basis, 0 dB. As the result gain of the sample antenna was −7.8 dB on an average in the AM broadcasting band of 535–1605 KHz. Considering that in the case of the aforementioned example of conventional window glass antennas the average gain (vs. whip antenna) was −10.5 dB, the antenna of FIG. 5 is judged to be a good and practicable antenna for receiving AM broadcast waves too.

Figure 6:
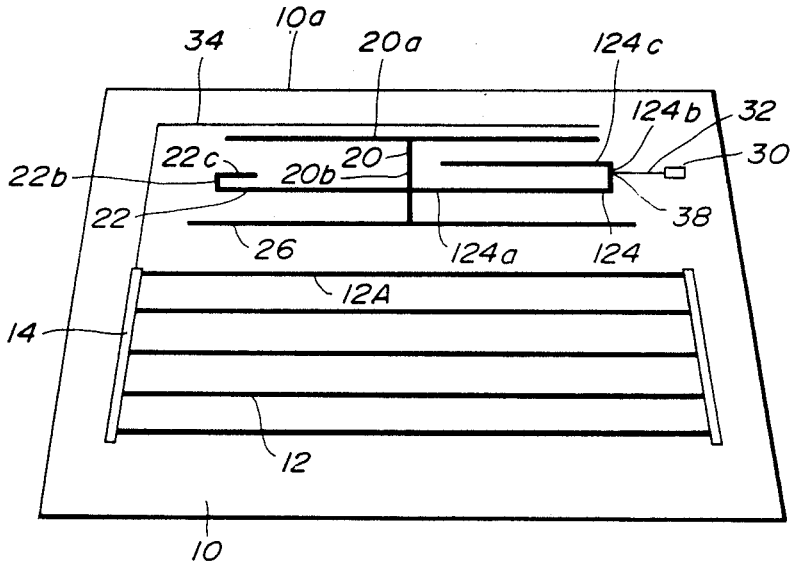
FIGS. 6 to 8 show three different modifications of the antenna of FIG. 5, respectively.

FIG. 6 shows a slight modification of the antenna of FIG. 5. That is, the second element 22 is supplemented with a short turn-up part **22*b* and a turn-back part 22*c* which extends horizontally toward the vertical part 20*b* of the first element 20. In this antenna, the second auxiliary conductive line 36 in the antenna of FIG. 5** was omitted.

In receiving FM radio broadcast waves the antenna of FIG. 6 proved to be nearly equivalent in gains to the antenna of FIG. 5. In receiving AM radio broadcast waves a sample antenna of FIG. 6 exhibited an average gain of −8.2 dB (vs. whip antenna) in the 535–1605 KHz band.

Figure 7:
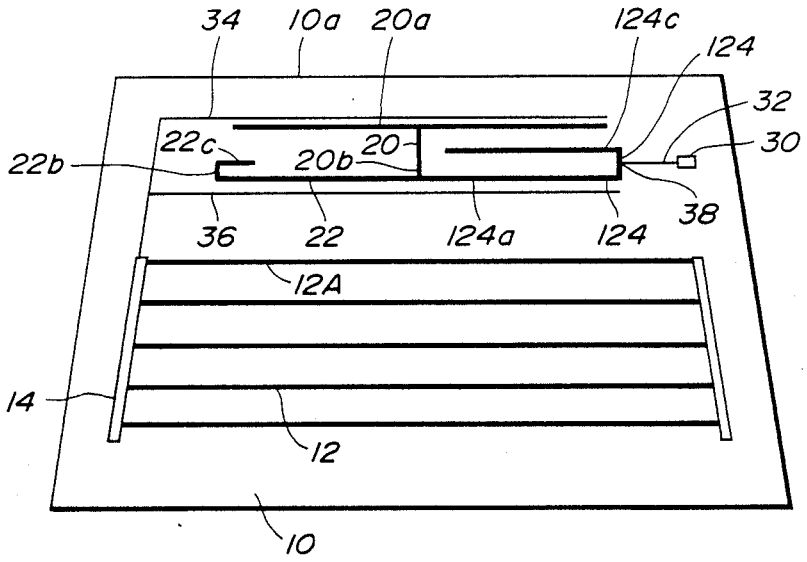

FIG. 7 shows another modification of the antenna of FIG. 5. Also in this case the second element 22 is supplemented with the turn-up part **22*b* and the turn-back part 22*c* described with respect to FIG. 6. In this antenna the auxiliary element 26 shown in FIG. 5 is omitted, and the second auxiliary conductive line 36 is at a short distance from the second and third elements 22, 124 so as to make capacitive coupling with both the main part of the second element 22 and the base part 124*a*** of the third element.

Compared with the antenna of FIG. 5, the antenna of FIG. 7 exhibited only slightly lower gains in receiving either FM radio broadcast waves or AM radio broadcast waves.

Figure 8:
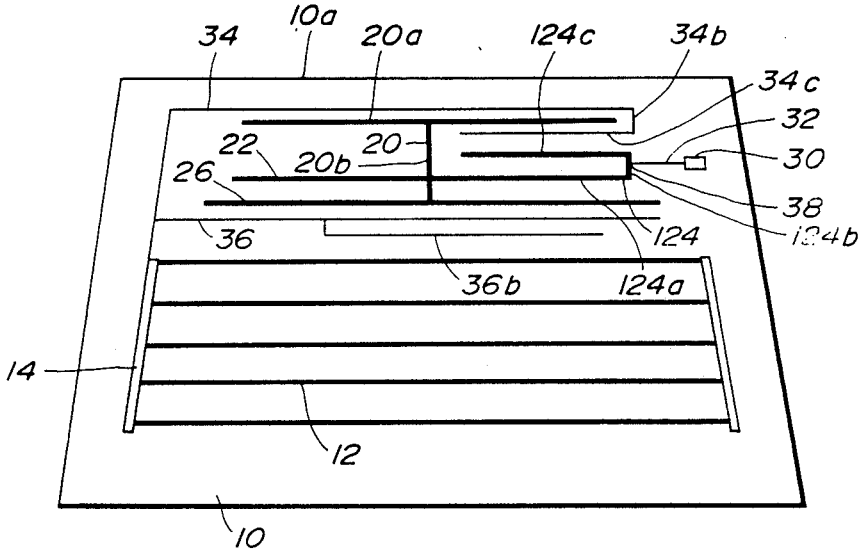

FIG. 8 shows another embodiment of the invention on the same automobile rear window glass. The antenna in FIG. 8 is a modification of the antenna of FIG. 5 only in respect of the auxiliary conductive lines 34 and 36.

In this antenna the first auxiliary conductive line 34 is supplemented at its free end with a short turn-down part **34*b* and a turn-back part 34*c* which extends parallel to the turn-back part 124*c* of the third element within the area between the third element 124 and the horizontal part 20*a* of the first element 20. That is, the righthand portion of the horizontal part 20*a* of the first element is surrounded by the first auxiliary conductive line 34. Besides, the second auxiliary conductive line 36 is supplemented with a branch part 36*b* which extends below and parallel to the main part of this line 36**.

The above described sample of the window glass of FIG. 5 was modified to a sample of the window glass of FIG. 8 by modifying the conductive lines 34 and 36 in the above described manner. In the sample the branch part **36*b* of the second auxiliary conductive line had a horizontal length of 800 mm. Compared with the sample antenna of FIG. 5 the sample antenna of FIG. 8** exhibited equivalent gains in receiving FM radio broadcast waves and somewhat higher gains in receiving AM radio broadcast waves.

What is claimed is:

1. A vehicle window glass antenna attached to a vehicle window glass which is provided with a plurality of heater strips extending horizontally, the antenna being located above the heater strips and comprising:

a first element which is a T-shaped conductive strip comprising a horizontal part and a vertical part extending from said horizontal part toward the heater strips;

a second element which is a conductive strip and extends horizontally from a point on said vertical part of said first element so as to exist only on one side of said vertical part;

a third element which is a conductive strip and comprises a primary part which constitutes at least three sides of a horizontally elongate rectangle on the other side of said vertical part of said first element and a secondary part which extends horizontally from a point on said vertical part and connects to said primary part;

a connecting line which extends from a point on said primary part of said third element to a feed point disposed on the window glass;

an auxiliary conductive line which connects with said heater strips and comprises a horizontal part which makes capacitive coupling with said horizontal part of said first element, and another auxiliary conductive line connecting with said heater strips and including a horizontal part making capacitive coupling with at least one of said second element and said secondary part of said third element.

2. An antenna according to claim 1, wherein said another auxiliary conductive line further comprises a branch part which extends from a point on said horizontal part of said another auxiliary conductive line and extends horizontally.

3. An antenna according to claim 1, wherein said primary part of said third element constitutes the four sides of said rectangle, said connecting line extending from a point on one of the two horizontal sides of said rectangle.

4. An antenna according to claim 3, wherein said secondary part of said third element connects to the other of the horizontal sides of said rectangle.

5. An antenna according to claim 1, wherein said primary part of said third element constitutes one vertical side and two horizontal sides of said rectangle, said connecting line extending from a point on one of the two horizontal sides of said rectangle.

6. An antenna according to claim 5, wherein said secondary part of said third element connects to the other of the horizontal sides of said rectangle.

7. An antenna according to claim 1, wherein said primary part of said third element constitutes one vertical side and two horizontal sides of said rectangle, said one vertical side being relatively remote from said vertical part of said first element, said secondary part of said third element being a straight extension of one of the two horizontal sides of said rectangle, said connecting line extending from a point on said one vertical side of said rectangle.

8. An antenna according to claim 1, wherein said horizontal part of said first element turns in a free end portion thereof so as to have a relatively short vertical portion and a turn-back portion extending horizontally from the free end of said vertical portion toward said vertical part of said first element.

9. An antenna according to claim 1, wherein said first element comprises a branch part extending horizontally from a point on said vertical part.

10. An antenna according to claim 1, wherein said second element turns in a free end portion thereof so as to have a relatively short vertical portion and a turn-back portion extending horizontally from the free end of said vertical portion toward said vertical part of said first element.

11. An antenna according to claim 1, wherein said horizontal part of said auxiliary conductive line turns in a free end portion thereof to have a relatively short vertical portion extending downward and a turn-back portion which extends from the lower end of said vertical portion below and parallel to said horizontal part of said first element toward said vertical part of said first element.

12. A vehicle window glass antenna attached to a vehicle window glass which is provided with a plurality of heater strips extending horizontally, the antenna being located above the heater strips and comprising:

a first element which is a T-shaped conductive strip comprising a horizontal part and a vertical part extending from said horizontal part toward the heater strips;

a second element which is a conductive strip and extends horizontally from a point on said vertical part of said first element so as to exist only on one side of said vertical part;

a third element which is a conductive strip and comprises a primary part which constitutes at least three sides of a horizontally elongate rectangle on the other side of said vertical part of said first element and a secondary part which extends horizontally from a point on said vertical part and connects to said primary part;

a connecting line which extends from a point on said primary part of said third element to a feed point disposed on the window glass; and an auxiliary conductive line which connects with said heater strips and comprises a horizontal part which makes capacitive coupling with said horizontal part of said first element, an auxiliary element which is a conductive strip including a horizontal part extending from the lower end of said vertical part of said first element, and another auxiliary conductive line connecting with said heater strips and including a horizontal part making capacitive coupling with said horizontal part of said auxiliary element.

13. An antenna according to claim 12, wherein said auxiliary element is in the shape of a horizontally elongate rectangle.

* * * * *